US009190751B2

(12) United States Patent
Miyazaki

(10) Patent No.: US 9,190,751 B2
(45) Date of Patent: Nov. 17, 2015

(54) CONNECTOR AND HEADER FOR USE IN THE SAME

(75) Inventor: Yoji Miyazaki, Mie (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 13 days.

(21) Appl. No.: 13/879,765

(22) PCT Filed: Sep. 28, 2011

(86) PCT No.: PCT/JP2011/072191

§ 371 (c)(1),
(2), (4) Date: Apr. 16, 2013

(87) PCT Pub. No.: WO2012/053330

PCT Pub. Date: Apr. 26, 2012

(65) Prior Publication Data

US 2013/0217270 A1 Aug. 22, 2013

(30) Foreign Application Priority Data

Oct. 19, 2010 (JP) ..... 2010-234718

(51) Int. Cl.
*H01R 12/71* (2011.01)
*H01R 12/73* (2011.01)

(52) U.S. Cl.
CPC ..... *H01R 12/716* (2013.01); *H01R 12/73* (2013.01)

(58) Field of Classification Search
CPC ..... H01R 12/73; H01R 12/716
USPC ..... 439/660, 65, 66, 680, 357, 74, 862
See application file for complete search history.

(56) References Cited

U.S. PATENT DOCUMENTS

| | | | | |
|---|---|---|---|---|
| 5,478,248 | A | 12/1995 | Mitra et al. | |
| 5,626,482 | A * | 5/1997 | Chan et al. | 439/74 |
| 5,830,018 | A | 11/1998 | Simmel | |
| 6,793,506 | B1 * | 9/2004 | Hirata et al. | 439/74 |
| 7,591,684 | B2 * | 9/2009 | Zhang et al. | 439/660 |
| 7,658,636 | B2 * | 2/2010 | Takeuchi et al. | 439/357 |
| 8,109,771 | B2 | 2/2012 | Chen | |
| 8,562,379 | B2 * | 10/2013 | Miyazaki et al. | 439/660 |
| 2008/0268723 | A1 | 10/2008 | Miyazaki et al. | |

(Continued)

FOREIGN PATENT DOCUMENTS

| | | | |
|---|---|---|---|
| CN | 2735568 | Y | 10/2005 |
| CN | 201048179 | Y | 4/2008 |
| CN | 101295833 | A | 10/2008 |

(Continued)

OTHER PUBLICATIONS

International Search Report issued in International Patent Application No. PCT/JP2011/072191 mailed on Oct. 25, 2011.

(Continued)

*Primary Examiner* — Edwin A. Leon
(74) *Attorney, Agent, or Firm* — McDermott Will & Emery LLP

(57) ABSTRACT

A connector that electrically connects circuit boards to each other by fitting a header 20 and a socket 10 to each other. In such a connector, protruding portions with a protruding shape, which are brought into contact with the socket 10 when the header 20 and the socket 10 are fitted to each other, are provided on side surfaces of the header 20.

13 Claims, 12 Drawing Sheets

(56) References Cited

U.S. PATENT DOCUMENTS

| | | | | |
|---|---|---|---|---|
| 2009/0061655 | A1* | 3/2009 | Miyazaki et al. | 439/74 |
| 2010/0248524 | A1* | 9/2010 | Miyazaki et al. | 439/357 |

FOREIGN PATENT DOCUMENTS

| | | | |
|---|---|---|---|
| JP | 9-506734 | A | 6/1997 |
| JP | 9-237667 | A | 9/1997 |
| JP | 2002-184521 | A | 6/2002 |
| JP | 2006-086083 | A | 3/2006 |
| TW | M371330 | U1 | 12/2009 |

OTHER PUBLICATIONS

Taiwanese Search Report issued in Taiwanese Application No. 100135919 dated Jul. 28, 2014, w/English translation.

Office Action issued in Chinese Application No. 201180049546.0 dated Jan. 12, 2015, with English translation.

English Translation of Chinese Office Action dated Aug. 12, 2015 issued in corresponding Chinese Application No. 201180049546.0.

* cited by examiner (a)

(b)

(a)

(b)

(a)

(b)

CONNECTOR AND HEADER FOR USE IN THE SAME

RELATED APPLICATIONS

This application is a U.S. national phase application of PCT international application PCT/JP2011/072191 filed on Sep. 28, 2011, which claims priority to Japanese Patent Application No. 2010-234718 filed on Oct. 19, 2010. The disclosures of these applications including the specifications, the drawings, and the claims are hereby incorporated by reference in its entirety.

TECHNICAL FIELD

The present invention relates to a connector that electrically connects circuit boards to each other, and to a header for use in the same.

BACKGROUND ART

Heretofore, a connector, which electrically connects circuit boards to each other, has been known (refer to Patent Literature 1). That is to say, a header mounted on one of the circuit boards and a socket mounted on the other circuit board are fitted to each other, whereby contacts corresponding thereto are brought into contact with and conducted to each other, and conductor patterns of the circuit boards to which the respective contacts are connected are electrically connected to each other.

CITATION LIST

Patent Literature

[PTL 1] Japanese Patent Laid-Open Publication No. 2002-184521

SUMMARY OF INVENTION

However, heretofore, it has been necessary that the socket and the header be configured so that each thereof can have specifications unique thereto. For example, in order to manufacture a connector with a fitting height of 1.0 mm, it is necessary to manufacture a socket 100*a* for a height of 1.0 mm and a header 200*a* for the height of 1.0 mm as shown in FIG. 9. Meanwhile, in order to manufacture a connector with a fitting height of 1.2 mm, it is necessary to manufacture a socket 100*b* for a height of 1.2 mm and a header 200*b* for the height of 1.0 mm as shown in FIG. 10. Thus, heretofore, it has been necessary to manufacture four types of components in order to manufacture two types of connectors.

Accordingly, there is also known a connector capable of coping with two or more types of fitting heights, which are due to a difference in the headers, while making the socket side common thereto. That is to say, as shown in FIG. 11, a socket 100*c* for heights of 0.8 mm/1.0 mm copes with both of a header 200*c* for the height of 0.8 mm and a header 200*d* for the height of 1.0 mm. FIG. 12(*a*) shows a cross-sectional view when the socket 100*c* as described above is fitted to the header 200*c* for the height of 0.8 mm, and FIG. 12(*b*) shows a cross-sectional view when the socket 100*c* as described above is fitted to the header 200*d* for the height of 1.0 mm. Here, if the socket side is made common, then it is sufficient if only three types of components are manufactured in order to manufacture two types of connectors. However, as shown in FIG. 12(*b*), when the socket 100*c* is fitted to the header 200*d* for the height of 1.0 mm, spaces S are generated in portions shown by circles in the drawing. Therefore, there is a problem that the header 200*d* for the height of 1.0 mm is prone to wobble in an arrow direction in the drawing, resulting in that the fitting thereof to the socket 100*c* is prone to be released.

The present invention has been made in order to solve the above-described problem. It is an object of the present invention to provide a connector, in which the header is less likely to wobble in a fitted state thereof to the socket even in the case where the connector concerned can cope with two or more types of fitting heights, which are due to a difference in the headers, while making the socket side common thereto.

A connector according to a first aspect of the present invention is a connector that electrically connects circuit boards to each other by fitting a header and a socket to each other, wherein protruding portions with a protruding shape, which are brought into contact with the socket when the header and the socket are fitted to each other, are provided on side surfaces of the header.

A connector according to a second aspect of the present invention is characterized in that the protruding portions are formed over the whole of the side surfaces of the header.

A connector according to a third aspect of the present invention is characterized in that spots of the protruding portions, the spots being brought into contact with the socket, have a flat shape.

A connector according to a fourth aspect of the present invention is characterized in that spots of the protruding portions, the spots being brought into contact with the socket, have a shape transferred from a shape of the socket side.

A header according to a fifth aspect of the present invention is a header, characterized in being used for the connector according to any one of the first to fourth aspects.

BRIEF DESCRIPTION OF DRAWINGS

FIG. 1(*a*) is an overall perspective view of a header; and FIG. 1(*b*) is an overall perspective view of a socket.

FIG. 4(*a*) is an overall perspective view of a socket; and FIG. 4(*b*) is an overall perspective view of a header.

FIG. 5(*a*) is an enlarged view from arrow A of the socket; FIG. 5(*b*) is an enlarged view from arrow B of the header; and FIG. 5(*c*) is an enlarged view of a fitted state of both thereof.

FIG. 6(*a*) is an overall perspective view of the socket; and FIG. 6(*b*) is an overall perspective view of the header.

FIG. 7(*a*) is a cross-sectional view of the socket; and FIGS. 7(*b*) and 7(*c*) are cross-sectional views of the header.

FIG. 8(*a*) is a cross-sectional view when the socket and a header for a height of 1.0 mm are fitted to each other; and FIG. 8(*b*) is a cross-sectional view when the socket and a header for a height of 1.5 mm are fitted to each other.

FIG. 9(*a*) is an overall perspective view thereof; and FIG. 9(*b*) is a cross-sectional view thereof.

FIG. 10(*a*) is an overall perspective view thereof; and FIG. 10(*b*) is a cross-sectional view thereof.

FIGS. 11(*a*), 11(*b*) and 11(*c*) are overall perspective views thereof.

FIGS. 12(*a*) and 12(*b*) are cross-sectional views thereof.

DESCRIPTION OF EMBODIMENTS

A description is made below in detail of embodiments of the present invention with reference to the drawings.

Figure 1:
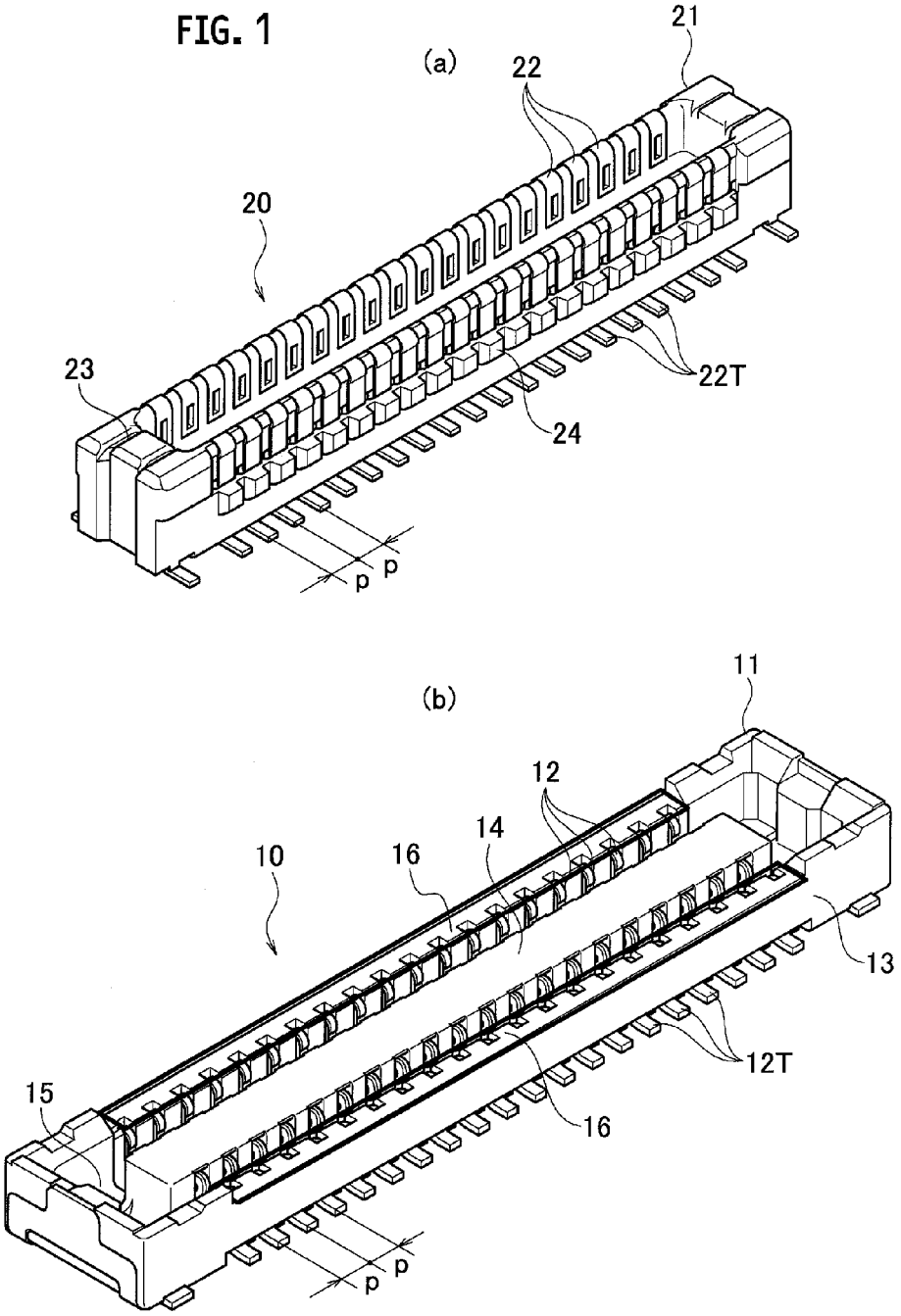
FIGS. 1(*a*) and 1(*b*) are views showing a connector of this embodiment.

FIG. 1(*a*) is an overall perspective view of a header 20 of this embodiment. As shown in this drawing, the header 20 includes a header molded article 21 molded of insulating synthetic resin into a rectangular shape as a whole. The header molded article 21 includes a peripheral wall portion 23 formed along a peripheral edge portion thereof. In a longitudinal direction of the header molded article 21, a plurality of header contacts 22 are attached at a predetermined pitch p. The header contacts 22 are belt-like metal members having a predetermined thickness. Connection terminal portions 22T of the header contacts 22 protrude outward from a lower edge of the peripheral wall portion 23, and are soldered to a conductor pattern of a circuit board (not shown). On side surfaces of the header 20 are formed protruding portions 24 with a protruding shape, which are brought into contact with the socket 10 when the header 20 and the socket 10 are fitted to each other.

Figure 2:
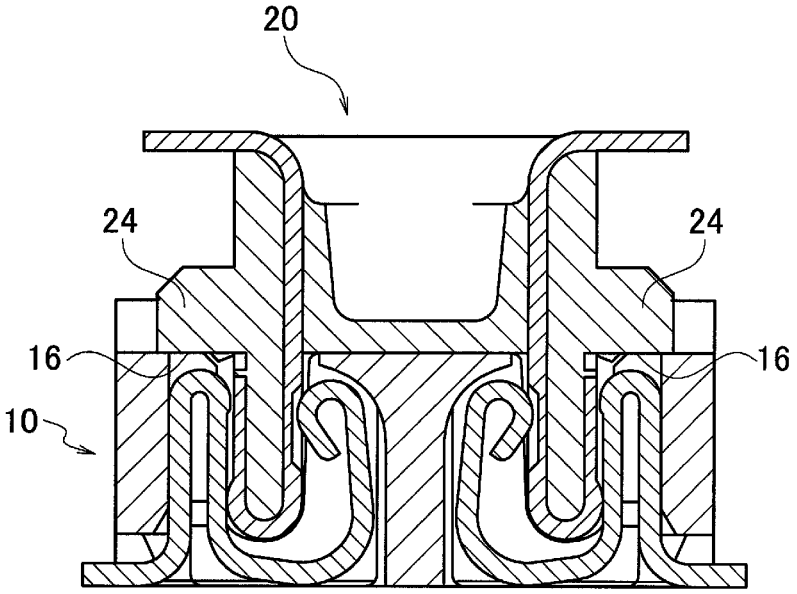
FIG. 2 is a cross-sectional view of the connector of this embodiment.

FIG. 1(*b*) is an overall perspective view of the socket 10 of this embodiment. As shown in this drawing, the socket 10 includes a socket molded article 11 made of insulating synthetic resin into a rectangular shape substantially similar to that of the header molded article 21 as a whole. The socket molded article 11 includes: a peripheral wall portion 13 formed along a peripheral edge portion thereof; and an island portion 14 formed on a center portion thereof. Between the peripheral wall portion 13 and the island portion 14, a fitting groove portion 15 that fits the header 20 thereto is formed. In a longitudinal direction of the socket molded article 11, a plurality of socket contacts 12 are attached at a pitch p equal to the pitch p of the header contacts 22. Like the header contacts 22, the socket contacts 12 are belt-like metal members having a predetermined thickness. Connection terminal portions 12T of the socket contacts 12 protrude outward from a lower edge of the peripheral wall portion 13, and are soldered to a conductor pattern of a circuit board (not shown). Here, surfaces 16 shown by thick-bordered boxes in the drawing are surfaces opposite to the protruding portions 24 of the header 20. That is to say, as shown in FIG. 2, when the header 20 is going to be inclined in a fitted state thereof, the protruding portions 24 of the header 20 are brought into contact with the surfaces 16 of the socket 10. In such a way, the protruding portions 24 serve as resistant portions, thereby making the header 20 less likely to wobble in the fitted state.

Figure 3:
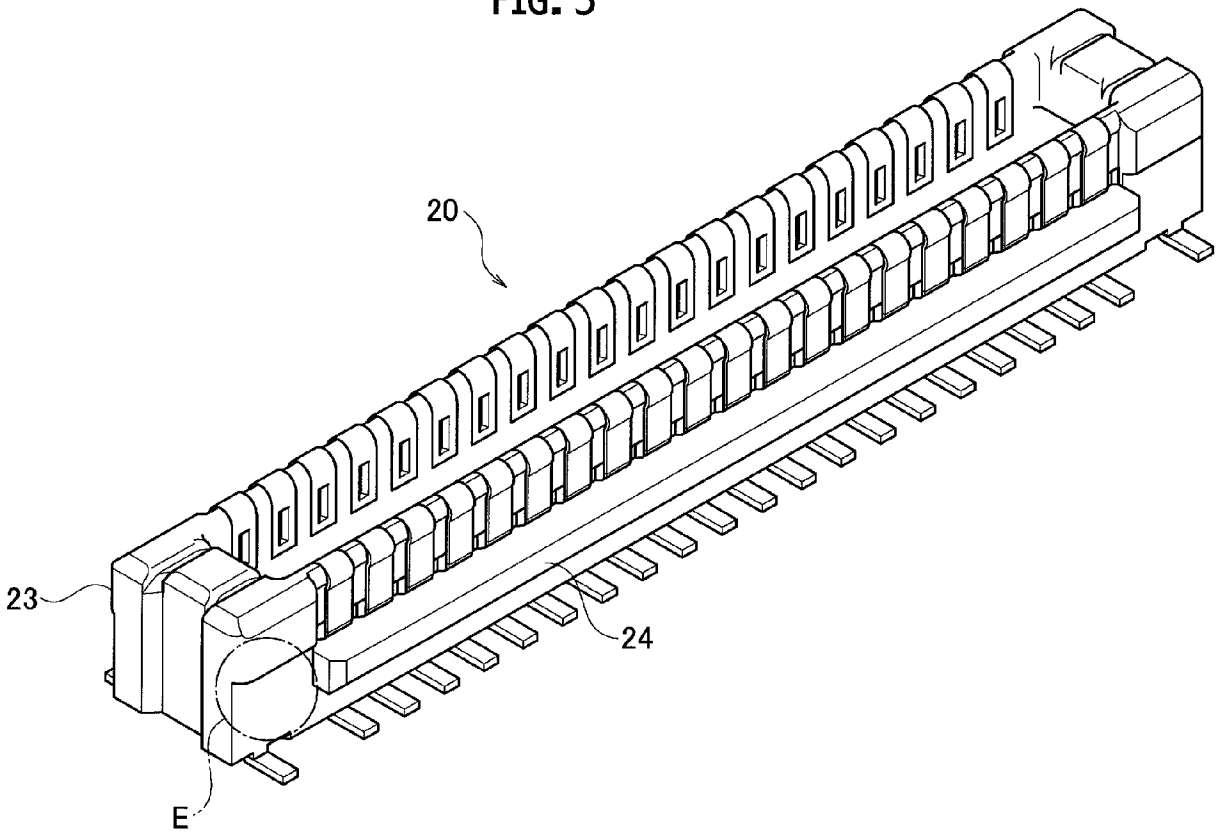
FIG. 3 is an overall perspective view of another header of this embodiment.

FIG. 3 is an overall perspective view of another header 20 of this embodiment. As shown in this drawing, the protruding portions 24 of the header 20 are formed over the whole of the side surfaces of the header 20. In such a way, an area of the header 20 brought into contact with the socket 10 is increased, thereby further making the header 20 less likely to wobble in the fitted state. However, with regard to a region E shown by a circle in the drawing, the peripheral wall portion 23 located above the same protrudes outward, so that it is not necessary to form each of the protruding portions 24 thereon. Moreover, as shown in this drawing, a spot of each of the protruding portions 24, which is brought into contact with the socket 10, may be formed into a flat shape. In such a way, the area of the header 20 brought into contact with the socket 10 is increased, thereby further making the header 20 less likely to wobble in the fitted state.

Figure 4:
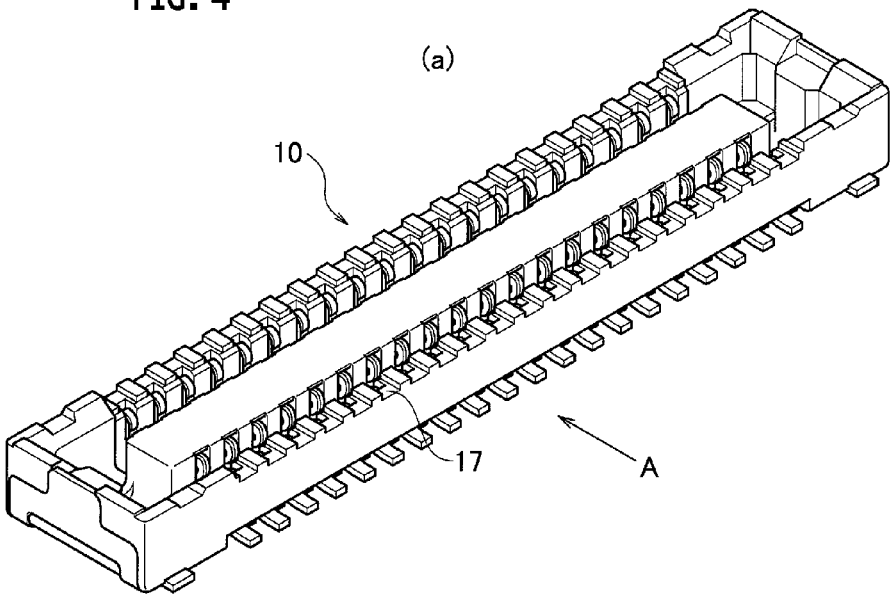
FIGS. 4(*a*) and 4(*b*) are views showing another connector of this embodiment.
Figure 4:
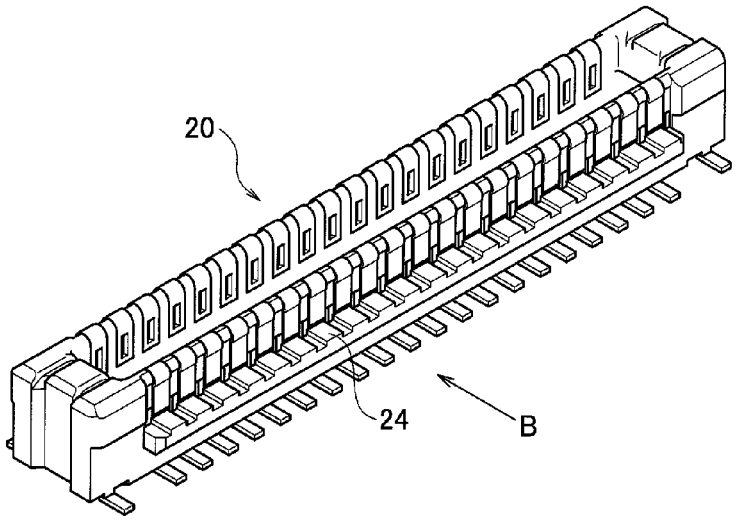
Figure 5:
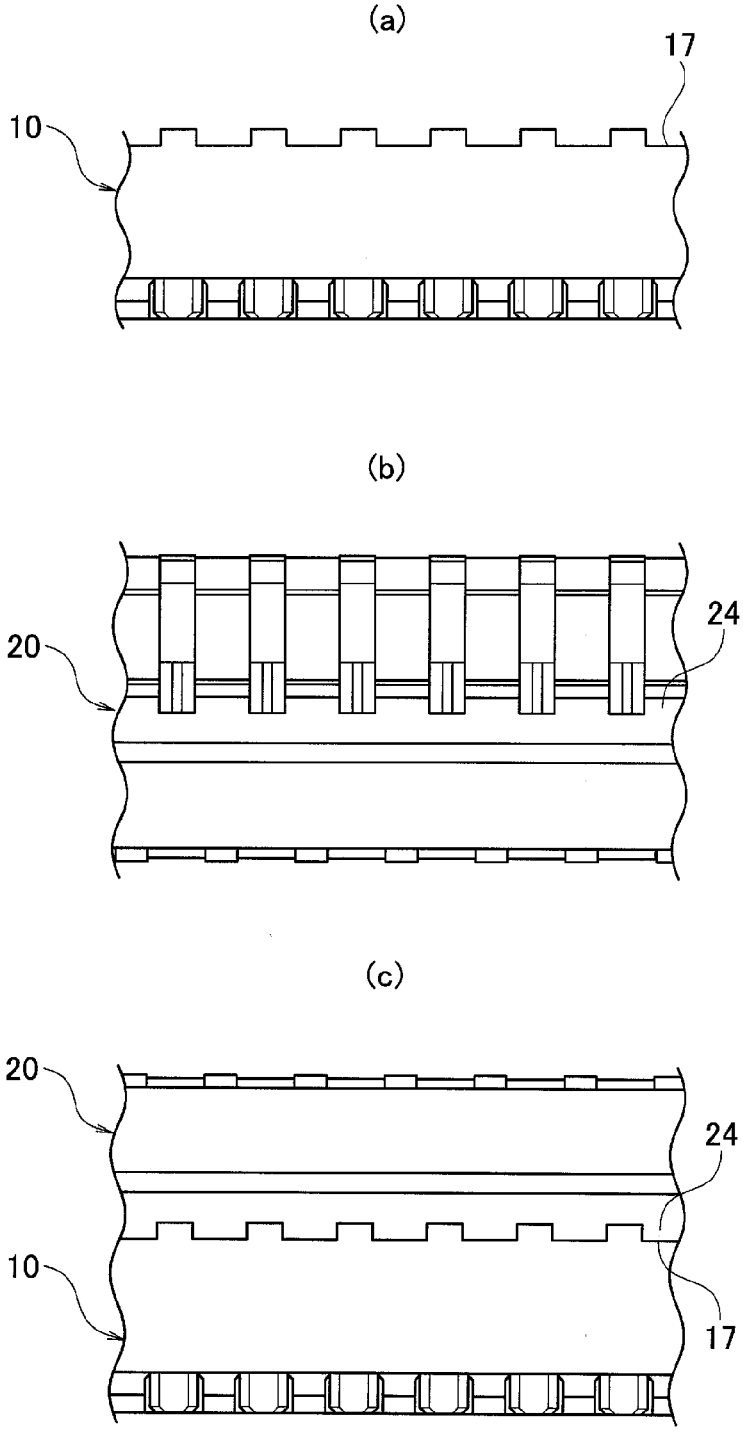
FIGS. 5(*a*) to 5(*c*) are views showing another connector of this embodiment.

FIG. 4 and FIG. 5 are views showing another connector of this embodiment. That is to say, FIG. 4(*a*) is an overall perspective view of a socket 10, and FIG. 4(*b*) is an overall perspective view of a header 20. Moreover, FIG. 5(*a*) is an enlarged view from arrow A of the socket 10 shown in in FIG. 4(*a*), FIG. 5(*b*) is an enlarged view from arrow B of the header 20 shown in FIG. 4(*b*), and FIG. 5(*c*) is an enlarged view of a fitted state of the socket 10 shown in FIG. 4 (a) and the header 20 shown in FIG. 4(*b*). As shown in these drawings, spots of protruding portions 24, which are brought into contact with the socket 10, may be formed into a shape transferred from a shape of the socket 10 side. That is to say, the protruding portions 24 have a shape transferred from recessed portions 17 on the socket 10 side. In such a way, the recessed portions 17 of the socket 10 and the protruding portions 24 of the header 20 mesh with each other in the fitted state, thereby further making the header 20 less likely to wobble in the fitted state.

Figure 6:
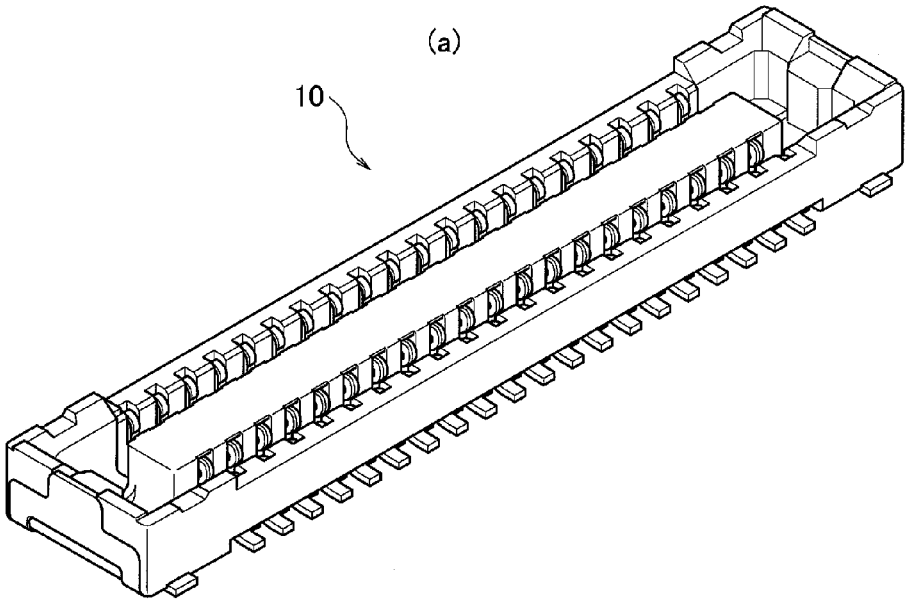
FIGS. 6(*a*) and 6(*b*) are views showing specific examples of the socket and header of this embodiment.
Figure 6:
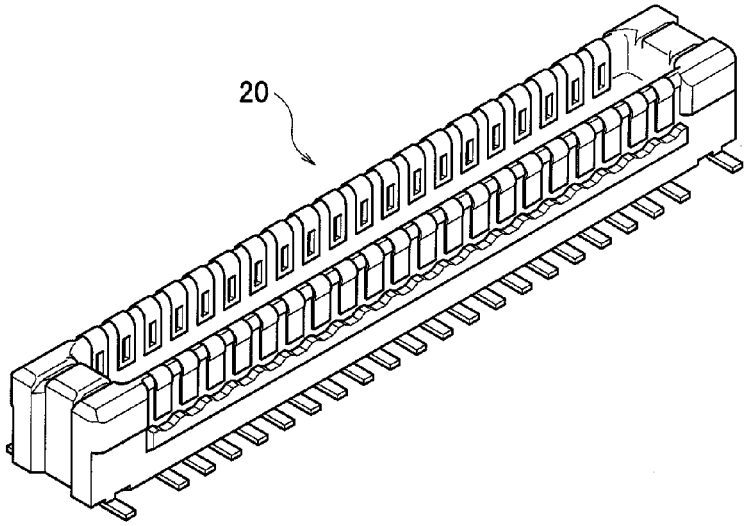
Figure 7:
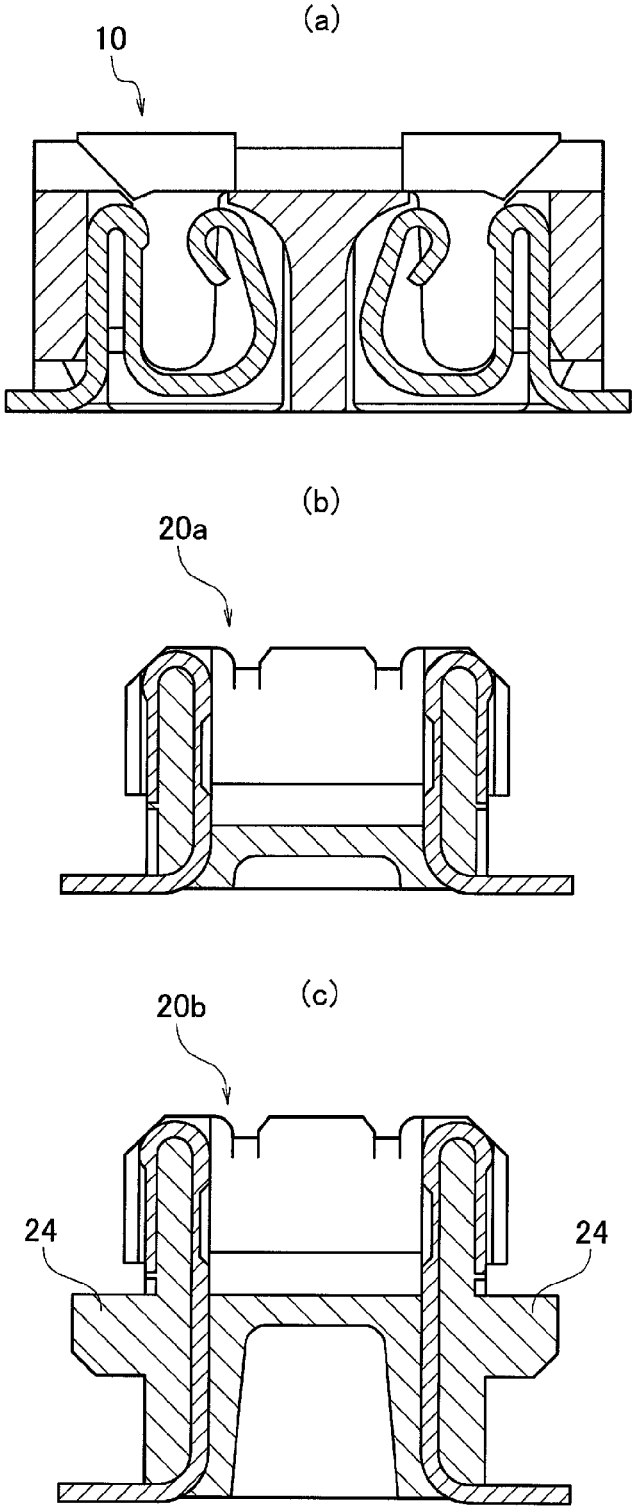
FIGS. 7(*a*) to 7(*c*) are views showing specific examples of the socket and header of this embodiment.
Figure 8:
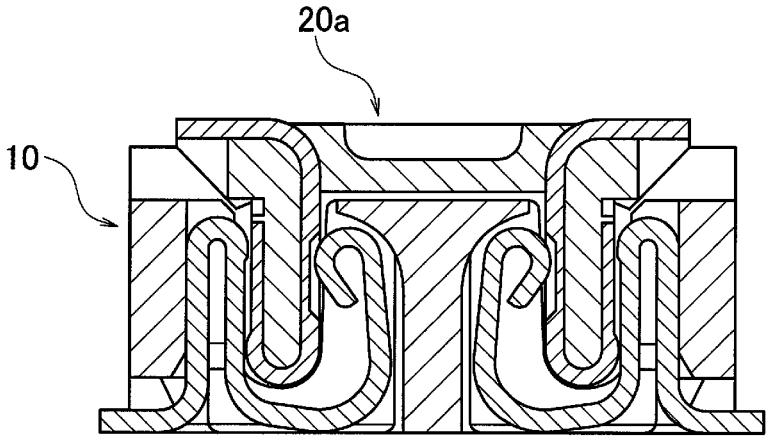
FIGS. 8(*a*) and 8(*b*) are cross-sectional views when the socket and header of this embodiment are fitted to each other.
Figure 8:
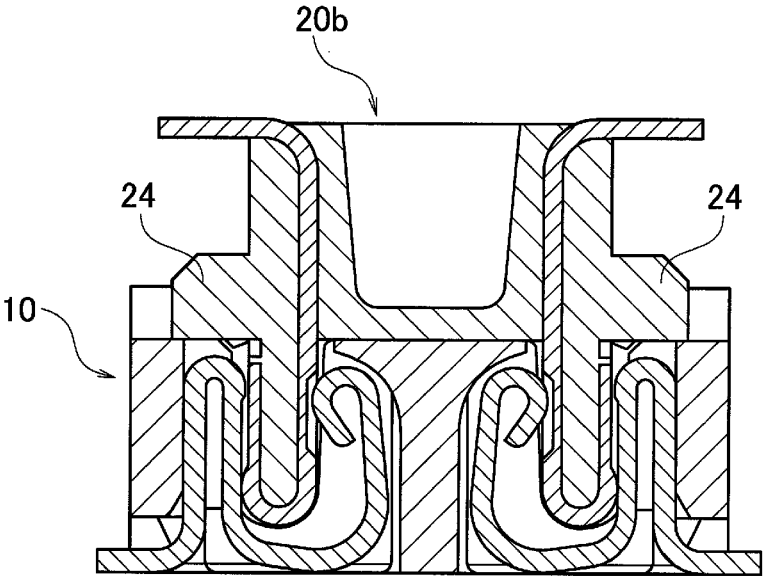
Figure 9A:
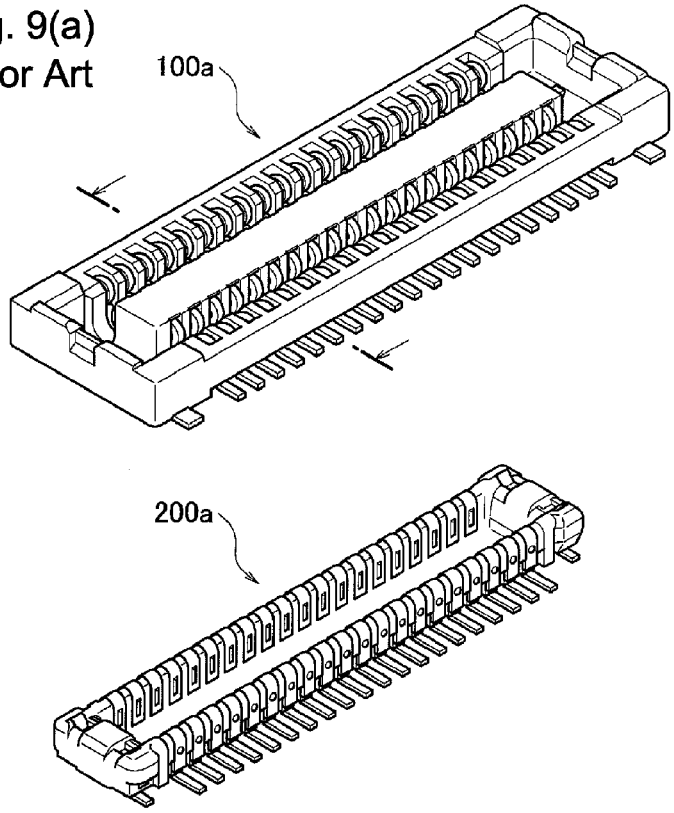
Fig. 9(a) Prior Art
FIGS. 9(*a*) and 9(*b*) are views showing a conventional connector.
Figure 9B:
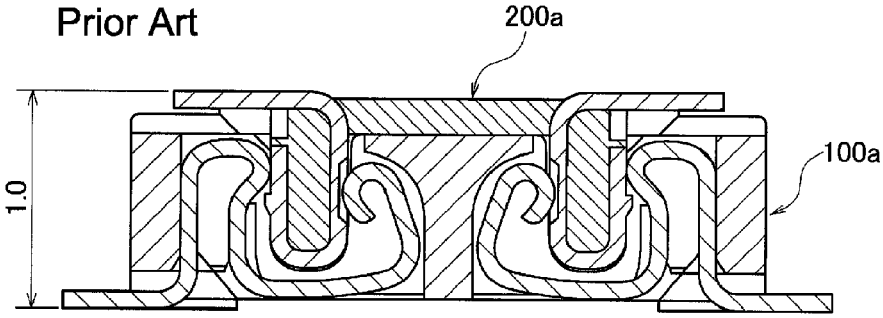
Fig. 9(b) Prior Art
Figure 10A:
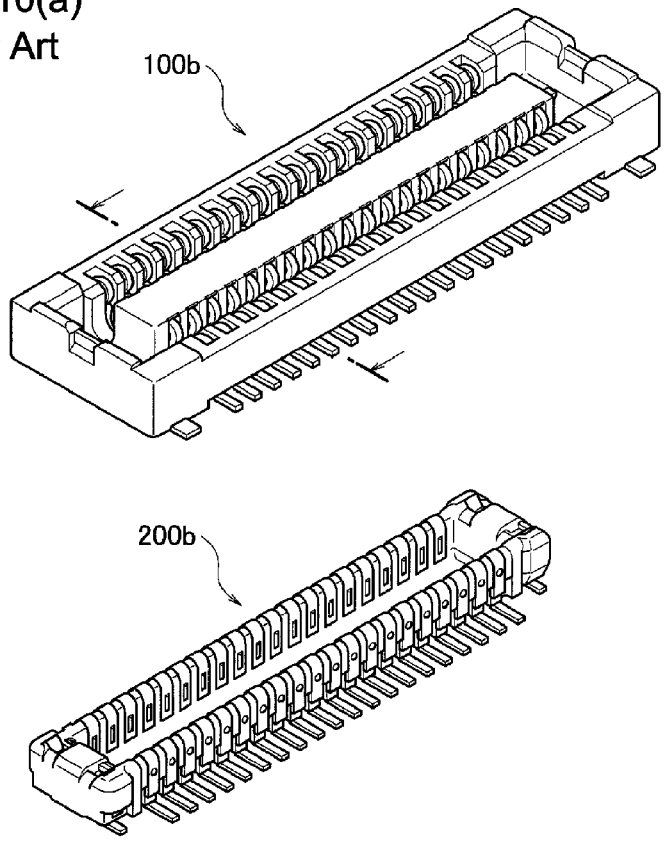
Fig. 10(a) Prior Art
FIGS. 10(*a*) and 10(*b*) are views showing a conventional connector.
Figure 10B:
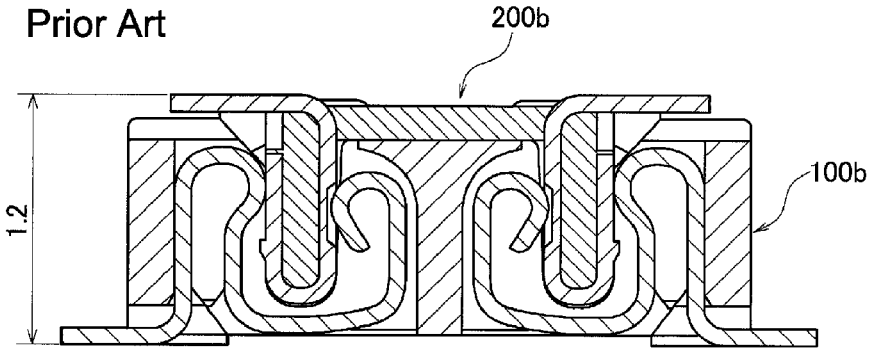
Fig. 10(b) Prior Art
Figure 11A:
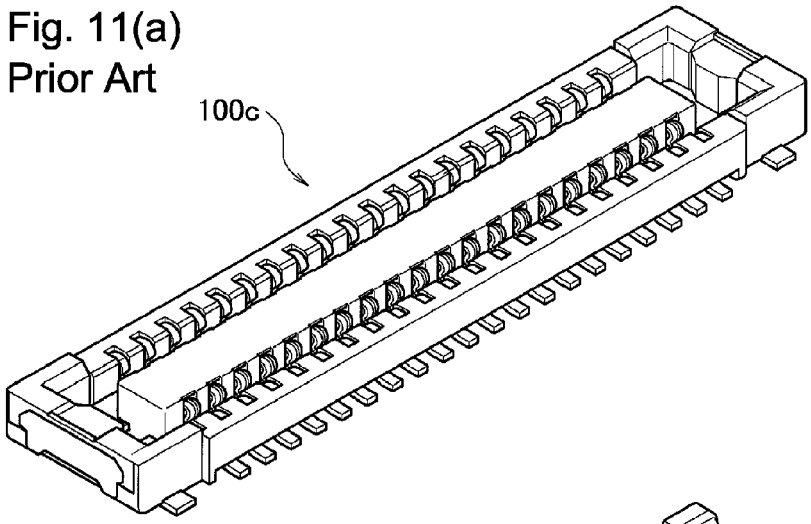
Fig. 11(a) Prior Art
FIGS. 11(*a*) to 11(*c*) are views showing another conventional connector.
Figure 11B:
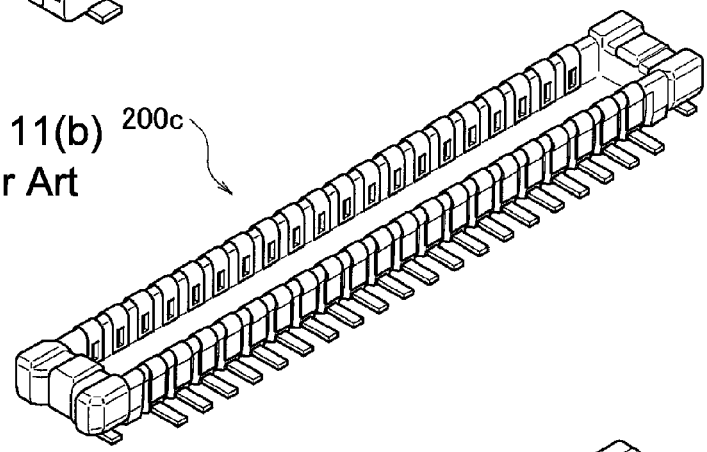
Fig. 11(b) Prior Art
Figure 11C:
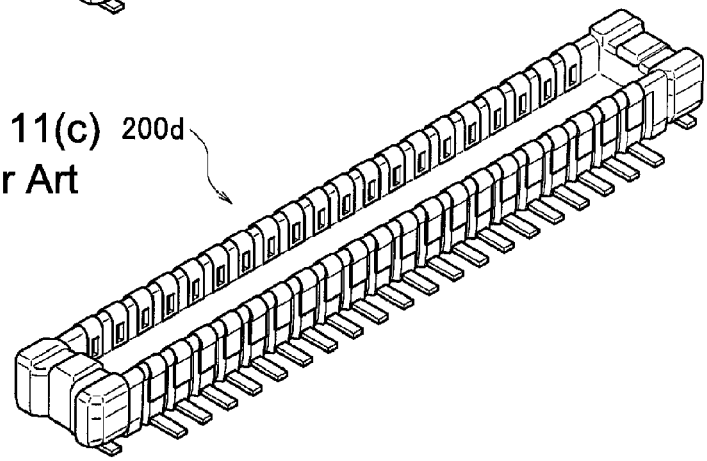
Fig. 11(c) Prior Art
Figure 12A:
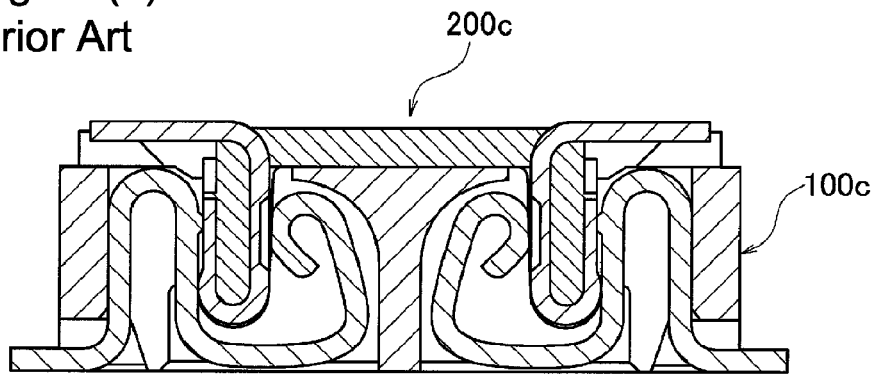
Fig. 12(a) Prior Art
FIGS. 12(*a*) and 12(*b*) are views showing still another conventional connector.
Figure 12B:
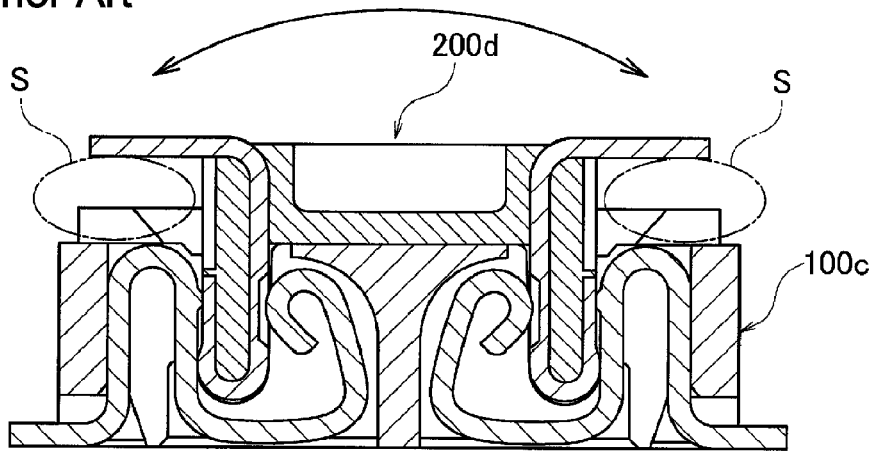
Fig. 12(b) Prior Art

FIG. 6 and FIG. 7 are views showing specific examples of the socket 10 and the header 20. That is to say, FIG. 6(*a*) is an overall perspective view of the socket 10, and FIG. 6(*b*) is an overall perspective view of the header 20. It is assumed that there are two types of this header 20, which are: a header 20*a* for a height of 1.0 mm; and a header 20*b* for a height of 1.5 mm. That is to say, FIG. 7(*a*) is a cross-sectional view of the socket 10 shown in FIG. 6(*a*), FIG. 7(*b*) is a cross-sectional view of the header 20*a* for the height of 1.0 mm, which is shown in FIG. 6(*b*), and FIG. 7(*c*) is a cross-sectional view of the header 20*b* for the height of 1.5 mm, which is shown in FIG. 6(*b*). Moreover, FIG. 8(*a*) shows a cross-sectional view when the socket 10 and the header 20*a* for the height of 1.0 mm are fitted to each other, and FIG. 8(*b*) shows a cross-sectional view when the socket 10 and the header 20*b* for the height of 1.5 mm are fitted to each other. As shown in these drawings, the connector of this embodiment can cope with two or more types of fitting heights, which are due to a difference in the headers, while making the socket 10 side common thereto. The protruding portions 24 are formed on the header 20*b* for the height of 1.5 mm. It is not specified whether or not to form the protruding portions 24 on the header 20*a* for the height of 1.0 mm.

As described above, the connector of this embodiment includes, on the side surfaces of the header 20, the protruding portions 24 with the protruding shape, which are brought into contact with the socket 10 when the header 20 and the socket 10 are fitted to each other. In such a way, it is possible to provide the connector, in which the header is less likely to wobble in the fitted state even in the case where the connector can cope with two or more types of the fitting heights, which are caused by a difference in the headers, while making the socket 10 side common thereto.

Moreover, in the connector of this embodiment, the protruding portions 24 are formed over the whole of the side surfaces of the header 20. In such a way, the area of the header 20 brought into contact with the socket 10 is increased, thereby further making the header 20 less likely to wobble in the fitted state.

Furthermore, in the connector of this embodiment, the spot of each of the protruding portions 24, which is brought into contact with the socket 10, has the flat shape. In such a way, the area of the header 20 brought into contact with the socket 10 is increased, thereby further making the header 20 less likely to wobble in the fitted state.

Moreover, in the connector of this embodiment, the spots of the protruding portions 24, which are brought into contact with the socket 10, have the shape transferred from the recessed portions 17 on the socket 10 side. In such a way, the recessed portions 17 of the socket 10 and the protruding portions 24 of the header 20 mesh with each other in the fitted state, thereby further making the header 20 less likely to wobble in the fitted state. In addition, by making the protruding shape of the protruding portions 24 a little larger than the recessed shape of the recessed portion 17, the protruding shape and the recessed shape can be meshed with each other in a press-fitted manner.

With the protruding shape and the recessed shape set in such a press-fitted manner as described above, it is made possible to further increase meshing force between the above two.

Though the description has been made above of the preferred embodiment, the present invention is not limited to the above-described embodiment but is modifiable in various ways. For example, specifications such as the sizes and materials of the molded articles, contacts and the like of the connector are changeable as appropriate.

The entire contents of Japanese Patent Application No. 2010-234718 (filed on Oct. 19, 2010) are incorporated herein by reference.

INDUSTRIAL APPLICABILITY

The present invention is useful for application to a connector, in which it is necessary that the header be made less likely to wobble in the fitted state even in the case where the connector can cope with two or more types of the fitting heights, which are due to the difference in the headers, while making the socket side common thereto, and to a header for use in the same.

REFERENCE SIGNS LIST

10 SOCKET
20 HEADER
24 PROTRUDING PORTION

The invention claimed is:

1. A connector that electrically connects circuit boards to each other by fitting a header and a socket to each other, wherein protruding portions with a protruding shape, the protruding portions being brought into contact with the socket when the header and the socket are fitted to each other, are provided on side surfaces of a header molded article in the header, said side surfaces of the header molded article extending parallel to a longitudinal axis of the header, the socket is provided with a fitting groove portion that receives the header, the header including a peripheral wall portion that is fitted into the fitting groove portion, and each of the protruding portions has a first surface which contacts a second surface of the socket, and the first surface of the protruding portions and the second surface of the socket intersect a fitting direction of the header and socket.

2. The connector according to claim 1, wherein the protruding portions are formed over a whole of side surfaces of the header.

3. The connector according to claim 1, wherein spots of the protruding portions, the spots being brought into contact with the socket, have a flat shape.

4. The connector according to claim 1, wherein spots of the protruding portions, the spots being brought into contact with the socket, have a shape transferred from a shape of the socket side.

5. A header to be used for the connector according to claim 1.

6. A header to be used for the connector according to claim 2.

7. A header to be used for the connector according to claim 3.

8. A header to be used for the connector according to claim 4.

9. The connector according to claim 1, wherein the side surfaces, on which the protruding portions are provided, extend parallel to the longitudinal axis of the header.

10. The connector according to claim 1, wherein the protruding portions contact a surface of the socket which extends parallel to the longitudinal axis of the socket.

11. The connector according to claim 1, further comprising header contacts disposed on the header so as to be exposed on the side surfaces of the header, wherein the protruding portions are disposed lower on the side surfaces than the header contacts relative to an upper surface of the header.

12. The connector according to claim 11, wherein each of the protruding portions is directly below a corresponding one of the header contacts when viewed in plan.

13. The connector according to claim 1, wherein the protruding portions extend outwardly from the side surfaces in a direction perpendicular to the longitudinal axis of the header.

* * * * *